US012275060B2

(12) United States Patent
Shibuta et al.

(10) Patent No.: US 12,275,060 B2
(45) Date of Patent: Apr. 15, 2025

(54) CONTINUOUS CASTING METHOD OF STEEL

(71) Applicant: JFE STEEL CORPORATION, Tokyo (JP)

(72) Inventors: Naoya Shibuta, Tokyo (JP); Satoshi Oyama, Tokyo (JP); Yoshiyuki Tanaka, Tokyo (JP); Akitoshi Matsui, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 18/269,057

(22) PCT Filed: Nov. 29, 2021

(86) PCT No.: PCT/JP2021/043677
§ 371 (c)(1),
(2) Date: Jun. 22, 2023

(87) PCT Pub. No.: WO2022/138002
PCT Pub. Date: Jun. 30, 2022

(65) Prior Publication Data

US 2024/0042515 A1 Feb. 8, 2024

(30) Foreign Application Priority Data

Dec. 25, 2020 (JP) ..... 2020-216099

(51) Int. Cl.
*B22D 11/115* (2006.01)
*B22D 11/00* (2006.01)
*B22D 11/041* (2006.01)

(52) U.S. Cl.
CPC ..... *B22D 11/115* (2013.01); *B22D 11/001* (2013.01); *B22D 11/041* (2013.01)

(58) Field of Classification Search
CPC ..... B22D 11/00; B22D 11/001; B22D 11/04; B22D 11/041; B22D 11/115
(Continued)

(56) References Cited

U.S. PATENT DOCUMENTS 4,331,196 A * 5/1982 Ohashi et al. ..... C21D 8/1205 164/476
2020/0331057 A1 10/2020 Okada et al.
2021/0138534 A1 5/2021 Okada

FOREIGN PATENT DOCUMENTS

CN 103998159 B 4/2016
EP 3572163 A1 11/2019
(Continued)

OTHER PUBLICATIONS

Jan. 11, 2022 International Search Report issued in International Application No. PCT/JP2021/043677.
(Continued)

*Primary Examiner* — Kevin P Kerns
(74) *Attorney, Agent, or Firm* — Oliff PLC

(57) ABSTRACT

A continuous casting method of steel of continuously casting a slab by using a vertical liquid bending type continuous casting machine. The method includes, while performing continuous casting by using an in-mold electromagnetic stirring device, applying an alternating-current moving magnetic field that moves in a width direction of a mold to molten steel inside the mold, inducing a swirling flow in the molten steel, and stirring the molten steel. A travel speed of the alternating-current moving magnetic field calculated by a specified formula is in a range of 0.20 to 1.50 m/s.

5 Claims, 1 Drawing Sheet

(58) Field of Classification Search
USPC ..... 164/466, 467, 468, 502, 503, 504
See application file for complete search history.

(56) References Cited

FOREIGN PATENT DOCUMENTS

| | | | |
|---|---|---|---|
| JP | H11-277197 | A | 10/1999 |
| JP | 2000-15413 | A | 1/2000 |
| JP | 2007-229736 | A | 9/2007 |
| JP | 2007-229737 | A | 9/2007 |
| JP | 2018-103198 | A | 7/2018 |
| TW | 302310 | B | 4/1997 |
| TW | 201836724 | A | 10/2018 |
| TW | 201946710 | A | 12/2019 |
| WO | 2013/091701 | A1 | 6/2013 |

OTHER PUBLICATIONS

Mar. 4, 2024 Extended European Search Report issued in European Application No. 21910154.0.
Sep. 2, 2022 Office Action issued in Taiwanese Patent Application No. 110145403.
Dec. 6, 2022 Office Action issued in Japanese Patent Application No. 2022-514551.
Aug. 2, 2024 Office Action issued in Korean Patent Application No. 2023-7019922.

* cited by examiner

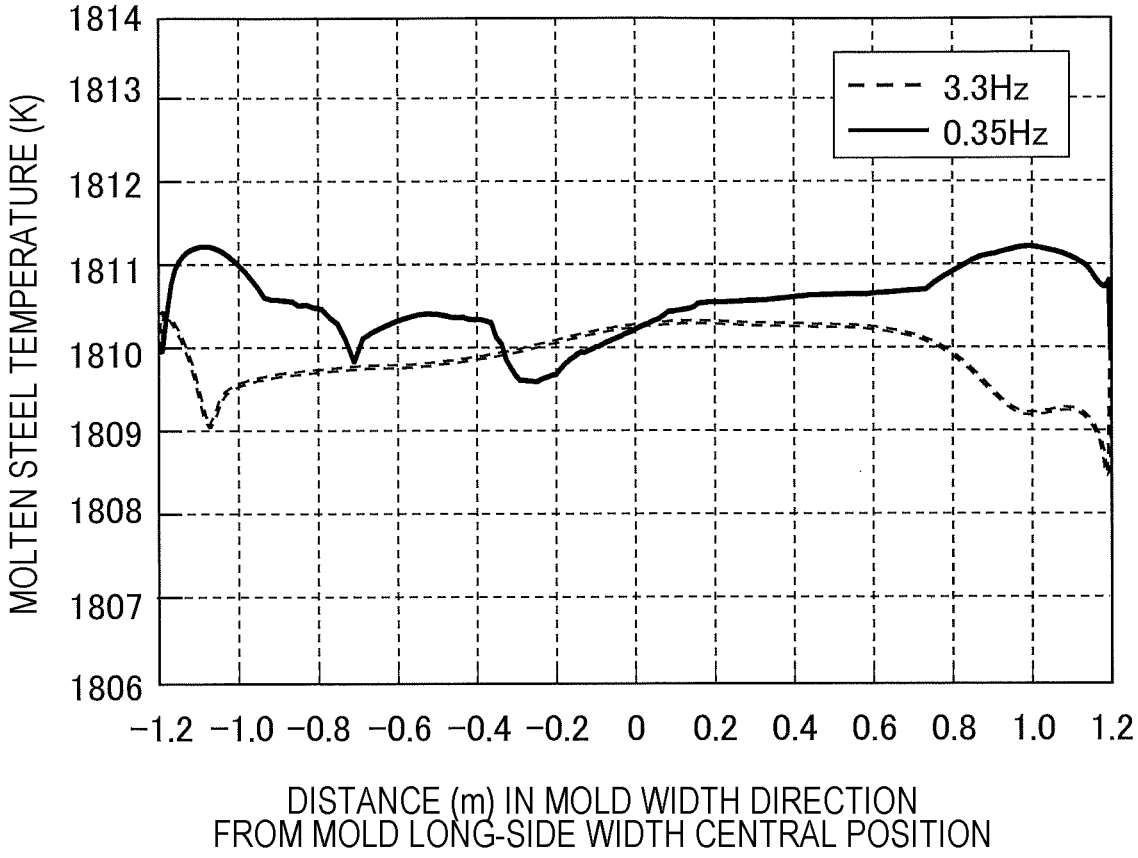
1814
1813
1812
1811
1810
1809
1808
1807
1806
MOLTEN STEEL TEMPERATURE (K)
3.3Hz
0.35Hz
−1.2 −1.0 −0.8 −0.6 −0.4 −0.2 0 0.2 0.4 0.6 0.8 1.0 1.2
DISTANCE (m) IN MOLD WIDTH DIRECTION
FROM MOLD LONG-SIDE WIDTH CENTRAL POSITION

CONTINUOUS CASTING METHOD OF STEEL

TECHNICAL FIELD

This application relates to a continuous casting method of steel of continuously casting a slab by a vertical liquid bending type continuous casting machine, and, specifically, to a continuous casting method of steel of performing continuous casting while applying an alternating-current moving magnetic field to molten steel inside a mold and inducing a swirling flow in the molten steel.

BACKGROUND

Among, for example, steel plates for boilers, low-alloy-steel steel plates for pressure vessels, and high-strength-steel steel plates for offshore structures or industrial machines, there are those used as critical members having a plate thickness exceeding 100 mm (high-quality extra-thick steel plates). Since in such high-quality extra-thick steel plates, the internal quality thereof may become a problem in terms of use performance, hitherto, a manufacturing method has been used. In the manufacturing method, a large ingot is manufactured by using an ingot casting method, and the large ingot is rolled or forged at a sufficient reduction ratio to manufacture high-quality extra-thick steel plates, as a result of which the internal quality of the high-quality extra-thick steel plates is improved.

On the other hand, since the ingot casting method above has low productivity, a method of manufacturing so-called "extra-thick slabs" having a large slab thickness by using a continuous casting method is being tested. However, in the extra-thick slabs obtained by the continuous casting method, a slab defect called center segregation or porosity tends to occur in a central portion of the slab thickness. That is, when manufacturing high-quality extra-thick steel plates from the extra-thick slabs obtained by the continuous casting method, since a sufficient reduction ratio cannot be ensured, the internal defect in the slabs remains and thus the internal quality of the high-quality extra-thick steel plates may become a problem. Here, "porosity" refers to a state in which a gap is formed by, for example, gas bubbles between crystal grains and the crystal grains are not densely provided.

When continuously casting extra-thick slabs by the continuous casting method, in general, very-low-speed casting is performed due to, for example, limitations in the length of a continuous casting facility or prevention of bulging of slabs. In low-speed casting of extra-thick slabs, the molten-steel injection amount into a mold per unit time is small, and a decrease in the temperature of the molten steel at a molten steel surface (may hereunder be referred to as "meniscus") inside the mold causes the molten steel to solidify, as a result of which a solidifying surface tends to be formed at the molten steel surface inside the mold. When such a solidifying surface of molten steel is formed, the inclusion of mold powder introduced to the molten steel surface inside the mold for the purpose of providing, for example, a lubricant and a heat insulator, and the mixture of a solidifying surface of molten steel portion into the slabs cause an internal defect to occur in the extra-thick slabs.

Patent Literature 1 discloses a method of, in continuously casting extra-thick slabs having a thickness of 400 mm or greater, electromagnetically stirring molten steel inside a mold, and setting a swirling flow speed for molten steel near a meniscus. According to Patent Literature 1, the swirling flow speed is set for the molten steel near the meniscus to prevent the formation of a solidifying surface of molten steel at the meniscus and to suppress the growth of a solidified shell near the meniscus, as a result of which the problem caused by a decrease in the temperature of the molten steel at the meniscus inside the mold above can be solved.

Patent Literature 2 discloses, as a method of continuously casting extra-thick slabs having a slab thickness of 380 mm or greater at a slab casting speed of 0.2 m/min or lower by using a vertical type continuous casting machine, continuous casting by installing an immersion nozzle at a central portion with respect to a real slab thickness, continuous casting with the degree of superheat with respect to the liquidus temperature of molten steel inside a tundish being 10 to 50° C., and continuous casting while stirring molten steel inside a mold by electromagnetic stirring inside the mold.

According to Patent Literature 2, due to the continuous casting method above, a large number of nuclei of equiaxed crystals is produced in the molten steel and the grain diameter of equiaxed crystals that are produced in a central portion of the extra-thick slabs is decreased to suppress occurrence of porosity, as a result of which the toughness of a steel-plate product can be improved. In addition, Patent Literature 2 also discloses that, when continuous casting of the molten steel inside the mold is performed while stirring the molten steel inside the mold, the effect of decreasing the grain diameter of the equiaxed crystals is increased.

CITATION LIST

Patent Literature

PTL 1: Japanese Unexamined Patent Application Publication No. H11-277197

PTL 2: Japanese Unexamined Patent Application Publication No. 2007-229736

SUMMARY

Technical Problem

In recent years, even with regard to the extra-thick slabs above, there has been a demand for increasing productivity by performing continuous casting at a higher speed.

However, Patent Literature 1 only describes an example in which the slab casting speed is 0.25 m/min when the thickness of the extra-thick slabs is 400 mm, and also only describes, with regard to the condition of electromagnetic stirring inside the mold, electromagnetic stirring that is performed such that the swirling flow speed of the molten steel near the meniscus becomes 0.2 to 0.4 m/s.

In Patent Literature 2, a vertical type continuous casting machine is used, and, due to the relationship with the length of the continuous casting facility, the slab casting speed of the vertical type continuous casting machine must be set lower than the slab casting speed of a vertical liquid bending type continuous casting machine. Therefore, Patent Literature 2 only describes an example in which the slab casting speed is 0.15 to 0.16 m/min when the thickness of the extra-thick slabs is 380 mm. Patent Literature 2 does not describe the condition of electromagnetic stirring inside the mold in this case.

In this way, hitherto, when continuously casting extra-thick slabs by using a vertical liquid bending type continuous casting machine, the application condition of electromagnetic stirring inside the mold for casting the extra-thick slabs at a higher speed has not been found. In addition, since steel types for extra-thick slabs include steel types in which surface cracking tends to occur in a slab surface, such as hypoperitectic steels, when the slab casting speed is increased, the initial solidification inside the mold tends to be ununiform, and the risk of surface cracking in the extra-thick slabs is considerably increased.

That is, although, with regard to the quality of extra-thick slabs, the internal quality has hitherto been primarily considered, it is becoming necessary to set casting conditions also considering the prevention of surface cracking caused by an increase in the slab casting speed of extra-thick slabs.

In view of the situation above, it is an object of the disclosed embodiments to provide a continuous casting method of steel that prevents surface cracking simultaneously with ensuring the internal quality of slabs obtained by continuous casting at a higher speed by using a vertical liquid bending type continuous casting machine even if the slabs are extra-thick slabs.

Solution to Problem

The gist of embodiments for solving the problem above is as follows.

[1] A continuous casting method of steel of continuously casting a slab by using a vertical liquid bending type continuous casting machine, wherein when performing continuous casting while, by using an in-mold electromagnetic stirring device, applying an alternating-current moving magnetic field that moves in a width direction of a mold to molten steel inside the mold, inducing a swirling flow in the molten steel, and stirring the molten steel, a travel speed of the alternating-current moving magnetic field that is calculated by Formula (1) below is 0.20 to 1.50 m/s:

$$U=2\tau f \quad (1)$$

where, in Formula (1), U is the travel speed (m/s) of the alternating-current moving magnetic field, $\tau$ is a distance (m) between magnetic poles of a coil of the in-mold electromagnetic stirring device, and f is a frequency (Hz) of an electric current that is applied to the coil of the in-mold electromagnetic stirring device.

[2] In the continuous casting method of steel according to [1] above, the frequency of the electric current that is applied to the coil of the in-mold electromagnetic stirring device is 0.2 to 1.0 Hz.

[3] In the continuous casting method of steel according to [1] or [2] above, an effective value of a component in a thickness direction of the mold of a magnetic flux density of the alternating-current moving magnetic field is 0.008 T or greater in terms of an average value in the width direction of the mold inside the mold where a position in a height direction of the mold is a central position in a height direction of the coil of the in-mold electromagnetic stirring device and where a position in the thickness direction of the mold is a position that is 15 mm from an inner surface of a long side of the mold.

[4] In the continuous casting method of steel according to any one of [1] to [3] above, a thickness of the slab that is continuously cast is 360 mm to 540 mm.

[5] In the continuous casting method of steel according to any one of [1] to [3] above, a thickness of the slab that is continuously cast is 400 mm to 500 mm.

[6] In the continuous casting method of steel according to [4] or [5] above, a slab casting speed is 0.3 to 0.8 m/min.

[7] In the continuous casting method of steel according to any one of [1] to [6] above, an average flow speed of molten steel at a solidification interface of the slab at a position that is 50 mm below a molten steel surface inside the mold in a casting direction is 0.08 to 0.3 m/s.

Advantageous Effects

According to the disclosed embodiments, in continuously casting a slab by using a vertical liquid bending type continuous casting machine, electromagnetic stirring conditions inside a mold are suitably determined to continuously cast a slab having a good internal quality and without surface cracking under a condition of casting at a higher slab casting speed even if the slab is an extra-thick slab.

BRIEF DESCRIPTION OF THE DRAWINGS

FIG. 1 shows an example of numerical calculation results, and the results of examination of the effects of frequencies of an electric current that is applied to a coil on a molten steel temperature distribution inside a mold.

DETAILED DESCRIPTION

Disclosed embodiments are specifically described below.

A continuous casting method of steel according to the disclosed embodiments is a method of continuously casting a slab by using a vertical liquid bending type continuous casting machine. In the continuous casting method of steel, two magnetic poles that are opposite to each other with two mold long sides of a continuous casting mold therebetween are disposed at a rear surface of the two mold long sides of the continuous casting mold having the two mold long sides and two mold short sides and forming a rectangular internal space by the mold long sides and the mold short sides. These magnetic poles are disposed in a range in a width direction of the mold in which a maximum width of the slab that is continuously cast by the vertical liquid bending type continuous casting machine is covered. The continuous casting is performed while, from these magnetic poles, an alternating-current moving magnetic field whose magnetic-field movement direction is the width direction of the mold is produced, the alternating-current moving magnetic field is applied to molten steel inside the mold, a swirl current is induced in the molten steel inside the mold, and the molten steel inside the mold is stirred.

When the alternating-current moving magnetic field is applied to the molten steel inside the mold, the molten steel inside the mold in a range in which the alternating-current moving magnetic field acts moves in directions of movements of the alternating-current moving magnetic field along a solidification interface of long sides of the slab. As a result of causing the directions of movements of the alternating-current moving magnetic field, the alternating-current magnetic field being applied from the two magnetic poles that are opposite to each other with the two mold long sides therebetween, to be opposite directions, molten steels that are near the solidification interface of the long sides of the slab that are opposite to each other move in opposite directions in the width direction of the mold. Therefore, a swirling flow of the molten steels that swirl in the width direction of the mold inside the mold is induced. Consequently, a stir flow of the molten steels having fluid-speed components rotating in a horizontal direction is produced in the molten steels inside the mold.

As long as the directions of movements of the alternating-current moving magnetic field that is applied from the two magnetic poles are opposite to each other, the directions of movements of the alternating-current moving magnetic field may be such that the directions of movements of the magnetic field when seen from directly above the mold are either clockwise directions or counterclockwise directions. The effects are the same for the clockwise directions and the counterclockwise directions. Note that from magnetic poles on the same rear-surface side with respect to the mold long sides, an alternating-current moving magnetic field in the same movement direction is applied.

Here, "vertical liquid bending type continuous casting machine" refers to a continuous casting machine whose mold and range that is a few meters below the mold are vertical, that is, perpendicular (vertical portion), whose portion below the vertical portion is curved (curved portion), and that pulls out a slab in a horizontal direction (horizontal portion) at a location beyond the curved portion. That is, "vertical liquid bending type continuous casting machine" refers to a continuous casting machine that pulls out a slab from the vertical portion to the curved portion with an unsolidified phase existing inside the slab.

The inventors examined a molten steel flow condition inside a mold when an extra-thick slab having a slab thickness of 400 mm to 500 mm and a slab width of 1900 mm to 2450 mm is continuously cast in a continuous casting method of controlling the flow of the molten steel inside the mold by using an alternating-current magnetic field such as that described above. Here, "extra-thick slab" refers to a slab having a slab thickness of 360 mm or greater. Although, ordinarily, the width of an extra-thick slab is approximately 1000 mm or greater, when a high-quality extra-thick steel plate is to be used, it is desirable that the mass per unit length of the extra-thick slab be large, in which case the slab width is 1600 mm or greater.

In this examination, as a result of primarily numerical calculation, the combination of the slab casting speed and the application condition of the alternating-current moving magnetic field is changed to repeatedly determine the flow speed distribution of the molten steel inside the mold. Note that the condition of an immersion nozzle for injecting the molten steel into the mold from a tundish is such that two rectangular discharge holes that are horizontally 65 mm in size and that are vertically 75 mm in size are used, the discharge angle of each discharge hole is 15 to 25 degrees downward from a horizontal direction, and the immersion depth is 200 mm. Here, "the immersion depth of the immersion nozzle" refers to a length (distance) from a meniscus up to an upper end of each discharge hole of the immersion nozzle.

The result is that, as a result of performing continuous casting under a condition in which the travel speed of the alternating-current moving magnetic field calculated by Formula (1) below satisfies 0.20 to 1.50 m/s, even if the casting condition is one in which the slab casting speed is 0.3 m/min or higher, a high-quality extra-thick slab having few defects is obtained.

$$U=2\tau f \quad (1)$$

In Formula (1), U is the travel speed (m/s) of the alternating-current moving magnetic field, $\tau$ is the distance (m) between magnetic poles of a coil of an in-mold electromagnetic stirring device, and f is the frequency (Hz) of an electric current that is applied to the coil of the in-mold electromagnetic stirring device.

The distance (pole pitch) $\tau$ between the magnetic poles of the coil of the in-mold electromagnetic stirring device ordinarily cannot be made variable, and is fixed to a certain value when a facility of the in-mold electromagnetic stirring device is introduced. Therefore, in order to control the travel speed of the alternating-current moving magnetic field that is calculated by Formula (1) above to the range of 0.20 to 1.50 m/s, the frequency of the electric current that is applied to the coil is adjusted depending on the distance $\tau$ between the magnetic poles of the coil of the in-mold electromagnetic stirring device that has been installed. For example, if the distance $\tau$ between the magnetic poles of the coil is 700 mm, the frequency of the electric current that is applied to the coil is in the range of 0.143 Hz to 1.071 Hz, as a result of which the travel speed U of the alternating-current moving magnetic field that is calculated by Formula (1) becomes 0.20 to 1.50 m/s. That is, if the frequency of the electric current that is applied to the coil is in the range of 0.2 to 1.0 Hz when the distance $\tau$ between the magnetic poles of the coil is 700 mm, the travel speed U of the alternating-current moving magnetic field that is calculated by Formula (1) becomes a value in the range of 0.20 to 1.50 m/s.

If the travel speed of the alternating-current moving magnetic field that is calculated by Formula (1) is less than 0.20 m/s, the travel speed of the alternating-current moving magnetic field is too low and the flow of the molten steel inside the mold is not controlled. On the other hand, if the travel speed of the alternating-current moving magnetic field that is calculated by Formula (1) exceeds 1.50 m/s, a swirling flow in the horizontal direction that is induced in the molten steel by the alternating-current moving magnetic field only exists near an inner surface of the mold (a swirling flow is unlikely to be induced in the molten steel near the center of the thickness of the mold), as a result of which the distribution of the molten-steel temperature at the molten steel surface inside the mold becomes notable. That is, compared with the temperature of the molten steel near the center of the thickness of the mold, the temperature of the molten steel near the inner surface of the mold is decreased, as a result of which the temperature difference of the molten steel at the molten steel surface inside the mold is increased and the quality of the slab is adversely affected. This is because, as the frequency of the electric current that is applied to the coil of the in-mold electromagnetic stirring device increases, the skin effect makes it less likely for the alternating-current moving magnetic field to permeate in a direction of the center of the thickness of the mold.

An example of numerical calculation results are shown in FIG. 1. FIG. 1 shows the results of examination of the effects of frequencies of an electric current that is applied to a coil on a molten steel temperature distribution at a position that is separated by 2.5 mm from a surface of the long sides of a mold when continuously casting an extra-thick slab having a slab thickness of 460 mm and a slab width of 2400 mm at a slab casting speed of 0.6 m/min. The distance $\tau$ between the magnetic poles of the coil is 700 mm in each case.

If the frequency of the electric current that is applied to the coil is 3.3 Hz, the travel speed of an alternating-current moving magnetic field calculated by Formula (1) becomes 4.6 m/s, and, thus, does not satisfy the range of the disclosed embodiments. At this time, as shown in FIG. 1, the difference between the maximum value and the minimum value of the molten steel temperature is 2.0° C. A part where the molten-steel temperature is low is formed near the short sides of the mold. This may show that a swirling flow produced by the alternating-current moving magnetic field has not reached the center of the thickness of the mold where an immersion nozzle, which is a supply source of molten steel having a high temperature, exists, and that only molten steel having a relatively low temperature near the inner surface of the mold is swirling due to the alternating-current moving magnetic field.

On the other hand, if the frequency of the electric current that is applied to the coil is 0.35 Hz, the travel speed of the moving magnetic field calculated by Formula (1) becomes 0.49 m/s, and, thus, satisfies the range of the disclosed embodiments. In this case, as shown in FIG. 1, the difference between the maximum value and the minimum value of the molten steel temperature is 1.6° C., which is smaller than the temperature difference when the electric current having a frequency of 3.3 Hz is applied to the coil, and, thus, the temperature distribution of the molten steel inside the mold approaches a uniform temperature distribution. The low-temperature portion confirmed when the frequency of the electric current that is applied to the coil is 3.3 Hz does not exist, and the molten steel temperature in almost all the width directions of the mold is higher when the frequency of the electric current that is applied to the coil is 0.35 Hz. This shows that, as a result of the swirling flow produced by the alternating-current moving magnetic field reaching the center of the thickness of the mold, the molten steel having a high temperature that is supplied from the immersion nozzle is supplied into the entire mold. Therefore, in the continuous casting of an extra-thick slab, even if the slab casting speed is increased, initial solidification inside the mold is unlikely to be ununiform, and the risk of surface cracking in the extra-thick slab can be reduced.

Note that it is preferable that the effective value of a component in a thickness direction of the mold of a magnetic flux density of the alternating-current moving magnetic field be 0.008 T or greater in terms of an average value in the width direction of the mold inside the mold where a position in a height direction of the mold is a central position in a height direction of the coil of the in-mold electromagnetic stirring device and where a position in a thickness direction of the mold is a position that is 15 mm toward the center of the thickness of the mold from an inner surface of the long sides of the mold. If the magnetic flux density that satisfies the above condition can be ensured at this position, a good molten steel flow inside the mold can be realized due to a swirling flow that is induced in the molten steel by the alternating-current moving magnetic field. Since, as the magnetic flux density of the alternating-current moving magnetic field is increased, a swirling flow is likely to be induced in the molten steel, an upper limit of the magnetic flux density need not be provided.

However, in order to increase the magnetic flux density, it is necessary to increase the electric current density that is applied to the coil. Considering facility costs for facilities that are durable with respect to a high electric current density and considering increase in power costs resulting from applying high electric current, it is practically sufficient for the effective value of the component in the thickness direction of the mold of the magnetic flux density of the alternating-current moving magnetic field to be 0.030 T or less in terms of the average value in the width direction of the mold.

It is more preferable that the average flow speed of molten steel at the solidification interface of a slab at a position that is 50 mm below the molten steel surface inside the mold in a casting direction be 0.08 to 0.3 m/s. Here, the average flow speed is a value that is obtained by spatially averaging a time average value of the flow speed of molten steel at a position that is 50 mm below the molten steel surface of the mold in the casting direction and where a solid phase ratio fs=0.5. This value can be determined by a numerical flow analysis considering the solidification of molten steel. For example, the magnitude of the time average value of each flow speed in a mesh at a location that is 50 mm below the molten steel surface inside the mold in the casting direction and where the solid phase ratio fs=0.5 by calculation (the magnitude of a three-dimensional flow-speed vector) can be determined by arithmetic means.

If the average flow speed of molten steel at the solidification interface of the slab at the position that is 50 mm below the molten steel surface inside the mold in the casting direction is lower than 0.08 m/s, for example, a nonmetallic inclusion suspended in the molten steel tends to be captured in a solidified shell, and the risk of producing defects in the slab is increased. On the other hand, if the average flow speed of molten steel at the solidification interface of the slab at the position that is 50 mm below the molten steel surface inside the mold in the casting direction exceeds 0.3 m/s, a molten steel flow collides with the solidified shell at a high speed and the solidified shell is redissolved, as a result of which the risk of a break-out during the continuous casting occurs.

In addition to providing the example above, the inventors confirmed the following tendencies by adding the condition in which the thickness of a slab is in the range of 360 mm to 540 mm and numerical calculations are performed.

The continuous casting method of steel according to the disclosed embodiments can better provide the effects for an extra-thick slab that is a slab manufactured by continuous casting and having a thickness of 360 mm to 540 mm. If the thickness of the slab is less than 360 mm, the slab is thin. Therefore, even if the swirling flow that is induced in the molten steel by the alternating-current moving magnetic field exists only near the inner surface of the mold, the stirring effect acts on the entire molten steel inside the mold, and the effects obtained by applying the disclosed embodiments is small. If the thickness of the slab exceeds 540 mm, in order to cause the alternating-current moving magnetic field to permeate up to the vicinity of the center in the thickness direction of the mold, it is necessary to increase the size of the in-mold electromagnetic stirring device, as a result of which facility costs of the in-mold electromagnetic stirring device are increased. Note that it is more preferable that the thickness of the slab subjected to continuous casting be 400 mm to 500 mm.

Further, for an extra-thick slab that is a slab subjected to continuous casting and having a thickness of 360 mm to 540 mm, when the disclosed embodiments is applied to a continuous casting operation in which the slab casting speed is 0.3 to 0.8 m/min, the effects thereof are remarkably achieved, which is preferable. Due to the disclosed embodiments, in continuously casting an extra-thick slab, it is possible to perform high-speed casting at a slab casting speed that is 0.3 m/min or higher, such a casting speed being difficult to realize in a vertical type continuous casting machine of the related art. Note that in continuously casting an extra-thick slab, if the slab casting speed exceeds 0.8 m/min, it becomes necessary to extend the length of a continuous casting facility and to increase the capacity of a refining step of supplying molten steel. Therefore, practically speaking, it is sufficient for the slab casting speed to be 0.8 m/min or lower.

As described above, according to the disclosed embodiments, in continuously casting a slab by using a vertical liquid bending type continuous casting machine, electromagnetic stirring conditions inside a mold are suitably determined to continuously cast a slab having a good internal quality and without surface cracking under a condition of casting at a higher slab casting speed even if the slab is an extra-thick slab.

EXAMPLES

Example 1

The disclosed embodiments were applied when an extra-thick slab having a slab thickness of 410 mm, having a slab width of 1900 mm, and containing carbon steel having a carbon content of 0.12 mass % was continuously cast at a slab casting speed of 0.8 m/min by using a vertical liquid bending type continuous casting machine whose vertical portion was 4.5 m in size.

An immersion nozzle that was used was a 2-hole-type immersion nozzle having rectangular discharge holes that were horizontally 65 mm in size and vertically 75 mm in size in left and right immersion nozzles, with the discharge angle of the discharge holes (angle with respect to a horizontal direction) being 15 degrees downward and the immersion depth being 200 mm.

The distance $\tau$ between magnetic poles of a coil of an in-mold electromagnetic stirring device that was used was 700 mm. In the in-mold electromagnetic stirring device, the effective value of a component in a thickness direction of the mold of a magnetic flux density of an alternating-current moving magnetic field was 0.008 T in terms of an average value in a width direction of a mold inside the mold where a position in a height direction of the mold was a central position in a height direction of the coil of the in-mold electromagnetic stirring device and where a position in the thickness direction of the mold was a position that was 15 mm from an inner surface of long sides of the mold.

In Example 1 of the disclosed embodiments, the continuous casting was performed with the frequency f of an electric current to be applied to the coil of the in-mold electromagnetic stirring device being 0.4 Hz (travel speed U of the alternating-current moving magnetic field=0.56 m/s).

For comparison, continuous casting was also performed under a condition in which an electric current was not applied to the coil of the in-mold electromagnetic stirring device, that is, under a condition in which electromagnetic stirring was not performed (Comparative Example 1), and under a condition in which the frequency f of an electric current to be applied to the coil of the in-mold electromagnetic stirring device was 3.3 Hz (travel speed U of the alternating-current moving magnetic field=4.62 m/s) (Comparative Example 2).

After the continuous casting, the internal quality and the surface quality of the manufactured extra-thick slabs were examined. With regard to the internal quality, the slabs were examined for center segregation, porosity, and internal cracking by sulfur printing and a hydrochloric-acid corrosion test of a cross section of polished slabs. With regard to the surface quality, after removing, for example, an oxide film on a surface of the slabs by shot blasting, the slabs were examined for longitudinal cracks, transverse cracks, and inclusions in the surface of the slabs by an immersion test.

In Example 1 of the disclosed embodiments, defects did not occur with regard to the internal quality and the surface quality of the extra-thick slab. In contrast, in Comparative Example 1, center segregation and porosity occurred. In Comparative Example 2, although the internal quality was good, longitudinal cracks occurred in the surface of the slab.

Example 2

The disclosed embodiments were applied when an extra-thick slab having a slab thickness of 460 mm, having a slab width of 2200 mm, and containing carbon steel having a carbon content of 0.16 mass % was continuously cast at a slab casting speed of 0.6 m/min by using a vertical liquid bending type continuous casting machine whose vertical portion was 4.5 m in size.

An immersion nozzle that was used was a 2-hole-type immersion nozzle having rectangular discharge holes that were horizontally 65 mm in size and vertically 75 mm in size in left and right immersion nozzles, with the discharge angle of the discharge holes (angle with respect to a horizontal direction) being 15 degrees downward and the immersion depth being 200 mm.

The distance $\tau$ between magnetic poles of a coil of an in-mold electromagnetic stirring device that was used was 700 mm. In the in-mold electromagnetic stirring device, the effective value of a component in a thickness direction of the mold of a magnetic flux density of an alternating-current moving magnetic field was 0.008 T in terms of an average value in a width direction of a mold inside the mold where a position in a height direction of the mold was a central position in a height direction of the coil of the in-mold electromagnetic stirring device and where a position in the thickness direction of the mold was a position that was 15 mm from an inner surface of long sides of the mold.

In Example 2 of the disclosed embodiments, the continuous casting was performed with the frequency f of an electric current to be applied to the coil of the in-mold electromagnetic stirring device being 0.4 Hz (travel speed U of the alternating-current moving magnetic field=0.56 m/s).

For comparison, continuous casting was also performed under a condition in which the frequency f of an electric current to be applied to the coil of the in-mold electromagnetic stirring device was 3.3 Hz (travel speed U of the alternating-current moving magnetic field U=4.62 m/s) (Comparative Example 3).

After the continuous casting, the internal quality and the surface quality of the manufactured extra-thick slabs were examined. With regard to the internal quality, the slabs were examined for center segregation, porosity, and internal cracking by sulfur printing and a hydrochloric-acid corrosion test of a cross section of polished slabs. With regard to the surface quality, after removing, for example, an oxide film on a surface of the slabs by shot blasting, the slabs were examined for longitudinal cracks, transverse cracks, and inclusions in the surface of the slabs by an immersion test.

In Example 2 of the disclosed embodiments, defects did not occur with regard to both the internal quality and the surface quality of the extra-thick slab. In contrast, in Comparative Example 3, although the internal quality was good, there were inclusions in the surface of the slab.

The invention claimed is:

1. A continuous casting method of steel of continuously casting a slab by using a vertical liquid bending continuous casting machine, the method comprising:

while performing continuous casting by using an in-mold electromagnetic stirring device, applying an alternating-current moving magnetic field that moves in a width direction of a mold to molten steel inside the mold;

inducing a swirling flow in the molten steel; and stirring the molten steel, wherein a travel speed U of the alternating-current moving magnetic field calculated by Formula (1) is in a range of 0.20 to 1.50 m/s:

$$U=2\tau f \quad (1)$$

where, in Formula (1), U is the travel speed (m/s) of the alternating-current moving magnetic field, t is a distance (m) between magnetic poles of a coil of the in-mold electromagnetic stirring device, and f is a frequency (Hz) of an electric current that is applied to the coil of the in-mold electromagnetic stirring device, wherein the frequency of the electric current that is applied to the coil of the in-mold electromagnetic stirring device is in a range of 0.2 to 1.0 Hz, and wherein an effective value of a component in a thickness direction of the mold of a magnetic flux density of the alternating-current moving magnetic field is 0.008 T or greater and 0.030 T or less in terms of an average value in the width direction of the mold inside the mold where a position in a height direction of the mold is a central position in a height direction of the coil of the in-mold electromagnetic stirring device and where a position in the thickness direction of the mold is a position that is 15 mm from an inner surface of a long side of the mold.

2. The continuous casting method of steel according to claim 1, wherein a thickness of the slab that is continuously cast is in a range of 360 mm to 540 mm.

3. The continuous casting method of steel according to claim 2, wherein a casting speed of the slab is in a range of 0.3 to 0.8 m/min.

4. The continuous casting method of steel according to claim 3, wherein an average flow speed of molten steel at a solidification interface of the slab at a position that is 50 mm below a molten steel surface inside the mold in a casting direction is in a range of 0.08 to 0.3 m/s.

5. The continuous casting method of steel according to claim 1, wherein an average flow speed of molten steel at a solidification interface of the slab at a position that is 50 mm below a molten steel surface inside the mold in a casting direction is in a range of 0.08 to 0.3 m/s.

* * * * *